United States Patent [19]

Quinby

[11] 3,955,093

[45] May 4, 1976

[54] TARGETS FOR THE PRODUCTION OF RADIOISOTOPES AND METHOD OF ASSEMBLY

[75] Inventor: Thomas C. Quinby, Kingston, Tenn.

[73] Assignee: The United States of America as represented by the United States Energy Research and Development Administration, Washington, D.C.

[22] Filed: Apr. 25, 1975

[21] Appl. No.: 571,446

[52] U.S. Cl. ..... 250/493

[51] Int. Cl.[2] ..... G21G 4/00

[58] Field of Search ..... 250/439, 456, 491, 492, 250/493, 496, 499, 500, 526; 176/10

[56] References Cited

UNITED STATES PATENTS 3,640,597 2/1972 Noble ..... 250/500 X 3,836,785 9/1974 Reifenschweiler ..... 250/499 X

*Primary Examiner*—Davis L. Willis

*Attorney, Agent, or Firm*—Dean E. Carlson; David S. Zachry; Allen H. Uzzell

[57] ABSTRACT

A target for preparation of radioisotopes by nuclear bombardment, and a method for its assembly are provided. A metallic sample to be bombarded is enclosed within a metallic support structure and the resulting target subjected to heat and pressure to effect diffusion bonds therebetween. The bonded target is capable of withstanding prolonged exposure to nuclear bombardment without thermal damage to the sample.

6 Claims, 2 Drawing Figures

TARGETS FOR THE PRODUCTION OF RADIOISOTOPES AND METHOD OF ASSEMBLY

BACKGROUND OF THE INVENTION

This invention was made in the course of, or under, a contract with the Energy Research and Development Administration.

This invention relates generally to the art of assembling targets for use in the preparation of radioisotopes by the nuclear bombardment of samples and more specifically to thin metal targets for use in bombardment where thermal damage to the sample is a problem.

Many radioisotopes are prepared by bombarding an appropriate target sample with highly energetic particles such as neutrons from a nuclear reactor or charged particles from a particle accelerator. When incident particles strike nuclei in the target sample, nuclear reactions may take place. The kinetic energy of the incident particles that react is consumed in the reaction but a significant portion of the incident particles are stopped in the target support after passing through the target material without reacting. The kinetic energy of these particles is dissipated as heat in the sample and the support. The removal of this target heat is a primary problem, because the energy dissipated as heat may be on the order of a kilowatt per square centimeter.

The nuclear reaction which occurs has a particular probability of occurring, or cross section. This cross section is dependent upon the kinetic energy and nuclidic nature of the incident particles. It has been known for some time that the cross section for a given reaction may be increased by increasing the energy of the incident particles to a value about 10 MeV above the threshold energy for the desired reaction. As the energy of the incident particles is increased, however, the amount of heat dissipated in the target is also increased, so in many cases it is the effectiveness of target heat removal which limits the operative maximum energy level of incident particles rather than the maximum cross section for the reaction.

The production rate of a specific product nuclide from a desired reaction depends directly upon the intensity of the incident particles, so it is desirable to use a high ion beam current. A thin metal sample is desirable as a target because only a selected energy range of particles react within the target. Thin metal targets are those targets which do not attenuate the intensity or energy of the incident particles significantly, so the reaction cross section is substantially uniform throughout the sample. It is seen, therefore, that the production rate for a specific nuclide by a particular reaction may be increased by using a thin target sample capable of withstanding bombardment by particles of high energy.

DESCRIPTION OF THE PRIOR ART

Because of the large rate of energy dissipation within a target sample, ion bombardments at high power levels had to be carried out using metal samples bolted or soldered to water cooled backing plates. This procedure is limited to those sample materials which are good thermal conductors and are inert to water under bombardment conditions, i.e., Cu. Non-metallic samples were powdered and pressed into grooves on a target plate and cooled by passing helium gas over the target surface. Thin targets of some metals could not be adequately cooled by helium, and water cooling would cause corrosion, making them unsuitable for many reactions. Indeed, some radioisotopes could not be economically produced because the energy level required to achieve the desired reaction would cause a thin metal target to melt, resulting in a loss of sample material. For example, a 0.08 mm thick uranium metal target was destroyed at 15 MeV $He^+$ input at a beam current of about 10 microamps. These radioisotopes were formerly produced by irradiation of oxide powders, but this so reduced the production rate for the specific nuclide that the process was uneconomical.

$^{236}Pu$ and $^{237}Pu$ are examples of radioisotopes which could not be produced economically before this invention. These radioisotopes are especially useful in studies of the effects of Pu on the environment. Because $^{239}Pu$ is produced in nuclear power reactors, its environmental effects are the subject of extensive study. The presence of $^{239}Pu$ within an organism is difficult to detect because $^{239}Pu$ decays by emitting alpha particles which are stopped inside the organism. The presence of $^{239}Pu$ may be detected only by destroying the organism.

The chemical behavior of $^{236}Pu$ and $^{237}Pu$ is identical to that of $^{239}Pu$; however, $^{236}Pu$ and $^{237}Pu$ decay by emitting gamma rays. Gamma rays pass easily through an organism and may be detected from the outside without destroying the organism. This makes $^{236}Pu$ and $^{237}Pu$ valuable as radioactive tracers.

Unfortunately, $^{236}Pu$ and $^{237}Pu$ have been difficult to produce. They can be produced by bombarding a highly enriched (about 93 percent $^{235}U$) uranium foil with deuterons to produce $^{236}Pu$ or with alpha particles to produce $^{237}Pu$. The major difficulty with this method is that the heat produced by the bombardment is normally sufficient to melt the foil. While the melted metal can be physically contained within a target support structure, the melted metal would change configuration resulting in serious loss of product and target material.

SUMMARY OF THE INVENTION

It is an object of the present invention to provide a method for assembling a target for nuclear bombardment which is capable of withstanding prolonged exposure to nuclear bombardment without thermal damage to a thin metal sample.

It is a further object of the present invention to provide a method for assembling targets for nuclear bombardment comprising enclosing a metallic sample within a metallic support structure and bonding the sample to the support structure by intermetallic diffusion.

It is a further object of the present invention to provide a target for nuclear bombardment which is capable of withstanding prolonged exposure to nuclear bombardment without thermal damage to a thin metal sample.

It has been found, according to this invention, that these and other objects may be accomplished by enclosing a metallic sample within a metallic support structure having sufficient thermal conductivity to prevent melting of the sample from the heat dissipated therein by the nuclear bombardment and subjecting the resulting structure to high temperature and pressure to form diffusion bonds between the sample and the interior surface support structure.

DESCRIPTION OF THE PREFERRED EMBODIMENT

It has been found according to the present invention that $^{236}$Pu and $^{237}$Pu can be produced without substantial target loss if a thin uranium foil is enclosed within a support structure having high thermal conductivity and bonded to the support structure by intermetallic diffusion bonding. Intermetallic diffusion bonding is defined as diffusion bonding in which an intermetallic phase exists between the bound metals. The heat dissipated within the target sample when it is bombarded is conducted away through the diffusion bond to the support structure, the heat conduction being so effective that the target sample is prevented from melting. The support structure should be formed of material having sufficient thermal conductivity for the desired application. The choice of support material depends upon the target material. Phase diagrams may be consulted to determine which support materials form intermetallic phases with the desired target material. Suitable materials for the support structure are silver, copper, gold, and aluminum, as well as some high melting point metals such as Ta if bonded at higher temperatures. In the preferred example, the support structure is copper as it has high thermal conductivity and is readily available.

Figure 1:
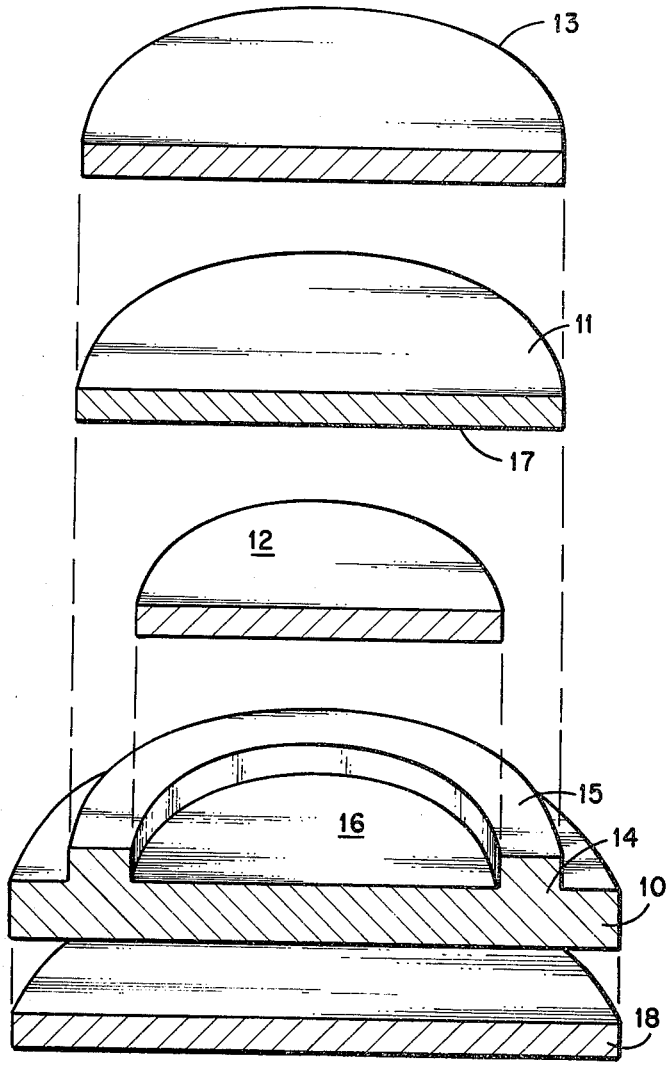
FIG. 1 is an expanded cutaway view of a target produced by the method of this invention.

Referring to FIG. 1, the target comprises a supportive backing plate (10), a thin cover plate (11), and a disk of target sample (12). The cover plate and supportive backing plate together make up a support structure for the target sample. Also shown are protective outer sheets (13) and (18) that are used in fabrication to prevent the metallic support structure from being bonded to the bonding press, and do not become a part of the target. The supportive backing plate (10) has a target sample area (16) of similar configuration to the target sample. This area may be recessed a depth of about 2 mils less than the thickness of the target material, or the partitions surrounding this area (14) may be 2 mils less than the thickness of the target sample. The cover plate should extend past the target material by at least about ⅛ inch so that bonding will occur between the cover plate and the backing plate thereby defining a target sample cavity. The cover plate should be sufficiently thin to avoid significant energy attenuation of the incident particles before striking the target material. The thickness of the cover plate and the target material is governed by the incident particle energy and by reaction energy threshold. The mating surfaces (15 and 17) of the target support structure are finished to the necessary degree to insure complete bonding therebetween. The thin protective outer sheets (13 and 18) have the same diametrical dimensions as the support structure. When the support structure is copper, the outer sheets may be tungsten.

The target sample is placed between the cover plate and the supportive backing plate. The target sample should be about 15 mils thick for $^{236}$Pu production and about 5 mils for $^{237}$Pu production. When the target is assembled before bonding, the cover plate and the supportive backing plate are separated by a distance of about 2 mils. The target is then placed in a conventional diffusion bonding press and subjected to high temperature and pressure. For example, satisfactory intermetallic diffusion bonds may be formed between copper and uranium surfaces at 750°C. and 3200 psig for 30 minutes, and between aluminum and copper at 500°C. and 3200 psig for 60 minutes. The main requirements of the bonding process are twofold; the bonding time must be limited to preclude diffusion of target material through the thin cover plate, and the seal must be complete, i.e., the target material should not be able to escape from the support structure.

Figure 2:
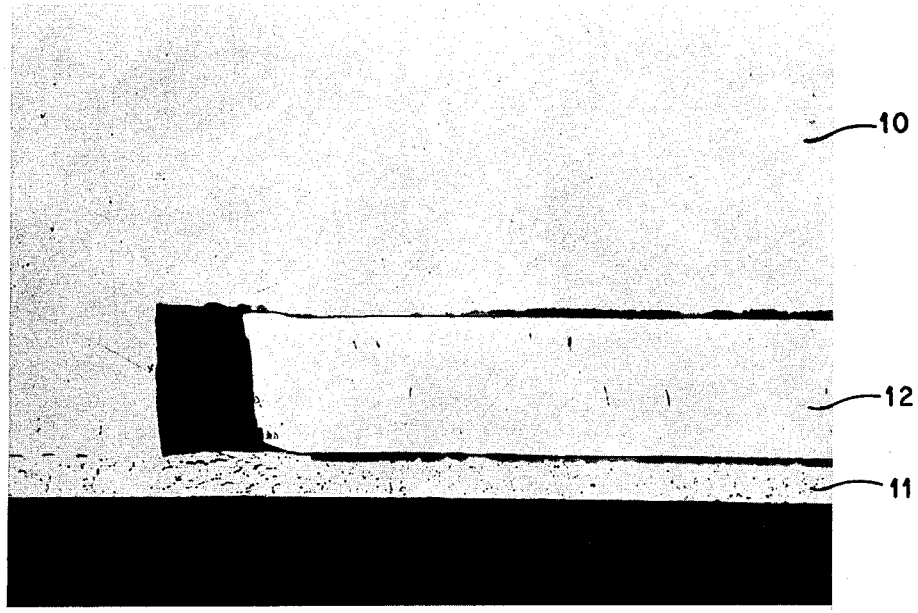
FIG. 2 is a photomicrograph of a cross section of a target showing the diffusion bonds between the sample and the support structure.

FIG. 2 is a photomicrograph showing the diffusion bonds between the sample and the support structure. The diffusion bond which forms between copper and uranium is an intermetallic phase. The presence of the intermetallic phase is believed to prevent the bond from breaking due to unequal expansion of the metals at high temperatures. In addition, the intermetallic diffusion bond is characterized by a continuous interface of high thermal conductivity between the sample and the support structure. This continuity is critical to the uniform conduction of heat from the sample through the support structure. If the thermal contact is not continuous, some of the sample material may melt and alloy with the metal of the support structure, resulting in loss of sample material.

With a target assembled by the above disclosed method, a $^{235}$U foil 15 mils in thickness is now able to withstand bombardment by deuterons at sufficient power level for economical production of $^{236}$Pu. A $^{235}$U foil 5 mils in thickness is now able to withstand bombardment by alpha particles at sufficient power level for economical production of $^{237}$Pu. After bombardment the support structures are dissolved away with nitric acid or other suitable methods. Only a small portion of the product radioisotopes is lost in the dissolution.

What is claimed is:

1. A method of assembling targets for the production of radioisotopes by the nuclear reaction of a metallic sample with incident particles, said method comprising enclosing said metallic sample within a metallic support structure and bonding said sample to the interior surface of said support structure by intermetallic diffusion bonding, said support structure having sufficient thermal conductivity to prevent melting of said sample from heat dissipated therein by said incident particles.

2. The method of claim 1 wherein said support structure is formed of metal selected from the group consisting of Al, Cu, Au, Ag, and Ta.

3. The method of claim 1 wherein said support structure comprises a backing plate and a cover plate spaced apart to define a target sample cavity therebetween, said backing plate and said cover plate being bound together at the periphery of said cavity forming a leakproof seal.

4. The method of claim 1 wherein said sample is uranium.

5. A target for the production of radioisotopes by the nuclear reaction of a metallic sample with incident particles, said target comprising a metallic sample within a metallic support structure, said sample being bound to the interior surface of said support structure by intermetallic diffusion bonding, said support structure having sufficient thermal conductivity to prevent melting of said sample from heat dissipated therein by said incident particles.

6. The target of claim 5 wherein said support structure comprises a backing plate and a cover plate spaced apart to define a target sample cavity therebetween, said backing plate and said cover plate being bound together at the periphery forming a leakproof seal.

* * * * *